US010350904B2

(12) United States Patent
Hasegawa

(10) Patent No.: US 10,350,904 B2
(45) Date of Patent: Jul. 16, 2019

(54) INKJET PRINTER

(71) Applicant: Roland DG Corporation, Hamamatsu-shi, Shizuoka (JP)

(72) Inventor: Hideyuki Hasegawa, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 15/907,498

(22) Filed: Feb. 28, 2018

(65) Prior Publication Data

US 2018/0257389 A1 Sep. 13, 2018

(30) Foreign Application Priority Data

Mar. 8, 2017 (JP) ..... 2017-043916

(51) Int. Cl.

| | |
|---|---|
| ***B41J 2/21*** | (2006.01) |
| ***B41J 2/155*** | (2006.01) |
| ***B41M 7/00*** | (2006.01) |
| ***B41J 11/00*** | (2006.01) |
| ***B41J 3/54*** | (2006.01) |
| ***B41M 3/00*** | (2006.01) |

(52) U.S. Cl.

CPC ..... *B41J 2/2121* (2013.01); *B41J 2/155* (2013.01); *B41J 2/2103* (2013.01); *B41J 2/2117* (2013.01); *B41J 3/543* (2013.01); *B41J 11/002* (2013.01); *B41M 3/008* (2013.01); *B41M 7/0081* (2013.01); *B41J 2202/21* (2013.01); *B41M 7/009* (2013.01)

(58) Field of Classification Search

CPC ..... B41J 2/2121; B41J 2/2117; B41J 2/2103; B41J 2/155; B41J 2002/21; B41J 11/002; B41M 3/008; B41M 3/5437; B41M 7/009

See application file for complete search history.

(56) References Cited

U.S. PATENT DOCUMENTS

| | | | | |
|---|---|---|---|---|
| 8,613,490 | B2 | 12/2013 | Usuda | |
| 8,911,047 | B2 | 12/2014 | Usuda | |
| 2004/0189772 | A1* | 9/2004 | Arai | B41J 3/543 347/102 |
| 2011/0050822 | A1 | 3/2011 | Fujisawa et al. | |
| 2011/0235069 | A1* | 9/2011 | Otsuka | B41J 2/15 358/1.8 |
| 2013/0027460 | A1* | 1/2013 | Usuda | B41J 2/2114 347/16 |
| 2013/0230701 | A1 | 9/2013 | Mochizuki | |
| 2014/0043386 | A1* | 2/2014 | Saita | B41J 11/002 347/15 |
| 2015/0224793 | A1* | 8/2015 | Tsuchiya | B41J 11/002 347/16 |
| 2017/0050449 | A1 | 2/2017 | Ikeda et al. | |

FOREIGN PATENT DOCUMENTS

| | | |
|---|---|---|
| JP | 2008-213271 A | 9/2008 |
| JP | 2011-126250 A | 6/2011 |
| JP | 2012-201060 A | 10/2012 |

* cited by examiner

*Primary Examiner* — Sharon A. Polk

(74) *Attorney, Agent, or Firm* — Keating & Bennett, LLP

(57) ABSTRACT

A printer includes a first ink head that ejects a first ink, a second ink head that ejects a second ink, a first dot controller that controls a dot size after curing of the ejected first ink, and a second dot controller that controls a dot size after curing of the ejected second ink. The second ink is ejected over the first ink on a recording medium, and the second ink is caused to have a dot size that is larger than a dot size of the first ink.

9 Claims, 8 Drawing Sheets

INKJET PRINTER

CROSS REFERENCE TO RELATED APPLICATIONS

This application claims the benefit of priority to Japanese Patent Application No. 2017-043916 filed on Mar. 8, 2017. The entire contents of this application are hereby incorporated herein by reference.

BACKGROUND OF THE INVENTION

1. Field of the Invention

The present invention relates to an inkjet printer.

2. Description of the Related Art

Conventionally, inkjet printers are known by which images are formed by overlapping different types of inks on recording media. For example, JP-A-2015-214133 discloses an inkjet printer including color ink heads that eject process color inks such as cyan (C), magenta (M), yellow (Y) and black (K) inks and a clear ink head that ejects a special color ink such as clear ink (CL).

In the inkjet printer disclosed in JP-A-2015-214133, a printed image is formed on a recording medium by causing the color ink heads to eject color inks onto the recording medium based on a preliminarily prepared print image. Then, an overcoat layer that covers the printed image is formed by causing the clear ink head to eject the clear ink over the color inks that have been ejected onto the recording medium. In this way, the inkjet printer of JP-A-2015-214133 performs overprinting in which two or more ink layers are stacked on top of each other.

In such overprinting, the number of heads that eject the ink for overcoat layer printing is generally smaller than the number of heads that eject color inks for image printing. For example, in an embodiment described in JP-A-2015-214133, there are four color ink heads (C, M, Y and K) whereas there is only one clear ink head (CL). When the number of heads for overcoat layer printing is smaller than the number of color ink heads as described above, the effect of the overcoat may be insufficient. More specifically, when a base color is printed over an image printed on a transparent recording medium, for example, the upper layer forming a ground color may not completely cover a lower layer forming an image and visual effects, such as one that makes images look sharper, cannot be achieved sufficiently.

SUMMARY OF THE INVENTION

Preferred embodiments of the present invention provide inkjet printers that ensure that an upper layer covers a lower layer in overprinting.

An inkjet printer according to a preferred embodiment of the present invention includes a first ink head that ejects a color ink on a recording medium; a second ink head that ejects a white ink on the color ink; a transporter that transports the recording medium from an upstream side to a downstream side in a sub-scanning direction; a carriage that moves the first ink head and the second ink head in a main scanning direction that is perpendicular or substantially perpendicular to the sub-scanning direction; a light emitter that emits light to cure the color ink ejected onto the recording medium and the white ink ejected onto the color ink, and a controller that controls the first ink head, the second ink head, the transporter, the carriage and the light emitter to cause the light emitter to emit light to the color ink after waiting a first time period from when the color ink has been ejected onto the recording medium and to cause the light emitter to emit light to the white ink after waiting a second time period from when the white ink has been ejected onto the color ink, the first time period being less than the second time period.

An inkjet printing method according to another preferred embodiment of the present invention includes ejecting a color ink on a recording medium; ejecting a white ink on the color ink; and emitting light to cure the color ink ejected onto the recording medium and the white ink ejected onto the color ink; wherein the emitting light includes emitting light to the color ink after waiting a first time period from when the color ink has been ejected onto the recording medium and emitting light to the white ink after waiting a second time period from when the white ink has been ejected onto the color ink; wherein the first time period is less than the second time period.

According to the above inkjet printer and inkjet printing method, the dot size of the second ink defining an upper layer, is able to be larger than that of the first ink defining a lower layer. This configuration ensures that the lower layer is covered with the upper layer. When the first ink is a process color ink and the second ink is a special color ink, the lower layer as an image layer is able to be reliably covered with the upper layer as a special color ink layer. This configuration reliably enables the special color ink to provide the image with an expected visual effect. In addition, the above inkjet printer is able to achieve the above-described advantageous effects without increasing the number of the nozzles in the second downstream side nozzle array or increasing the number of times of ejection from the nozzles in the second downstream side nozzle array. Thus, there is no possibility that the printing efficiency is lowered.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
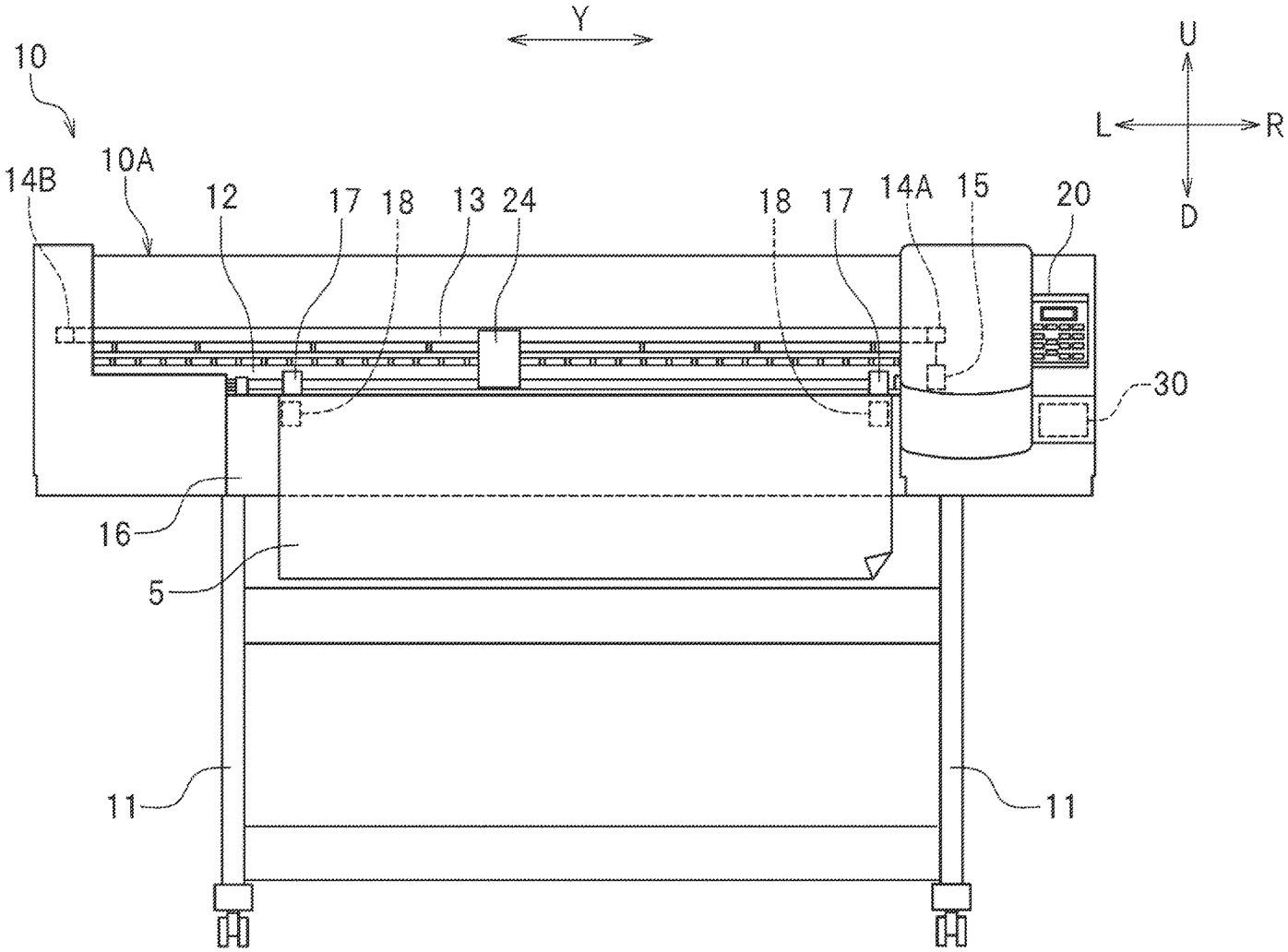
FIG. 1 is a front view of an inkjet printer according to a first preferred embodiment according of the present invention.

Description is hereinafter made of inkjet printers according to some preferred embodiments with reference to the drawings. It should be understood that the preferred embodiments described herein are not particularly intended to limit the present invention. In addition, members and elements that have the same functions are denoted by the same reference numerals or symbols and redundant description is omitted or simplified as appropriate. In the following description, the direction away from the inkjet printer and the direction approaching the inkjet printer as the inkjet printer is viewed from front is defined as forward and rearward, respectively. The reference symbol Y in the drawings represents a main scanning direction and the reference symbol X represents a sub-scanning direction X, which is perpendicular to the main scanning direction Y. The reference symbols F, Rr, L, R, U and D in the drawings represent front, rear, left, right, up and down, respectively. These are, however, directions used for convenience of description and are not intended to limit the installation mode, etc. of the inkjet printer.

First Preferred Embodiment

Figure 2:
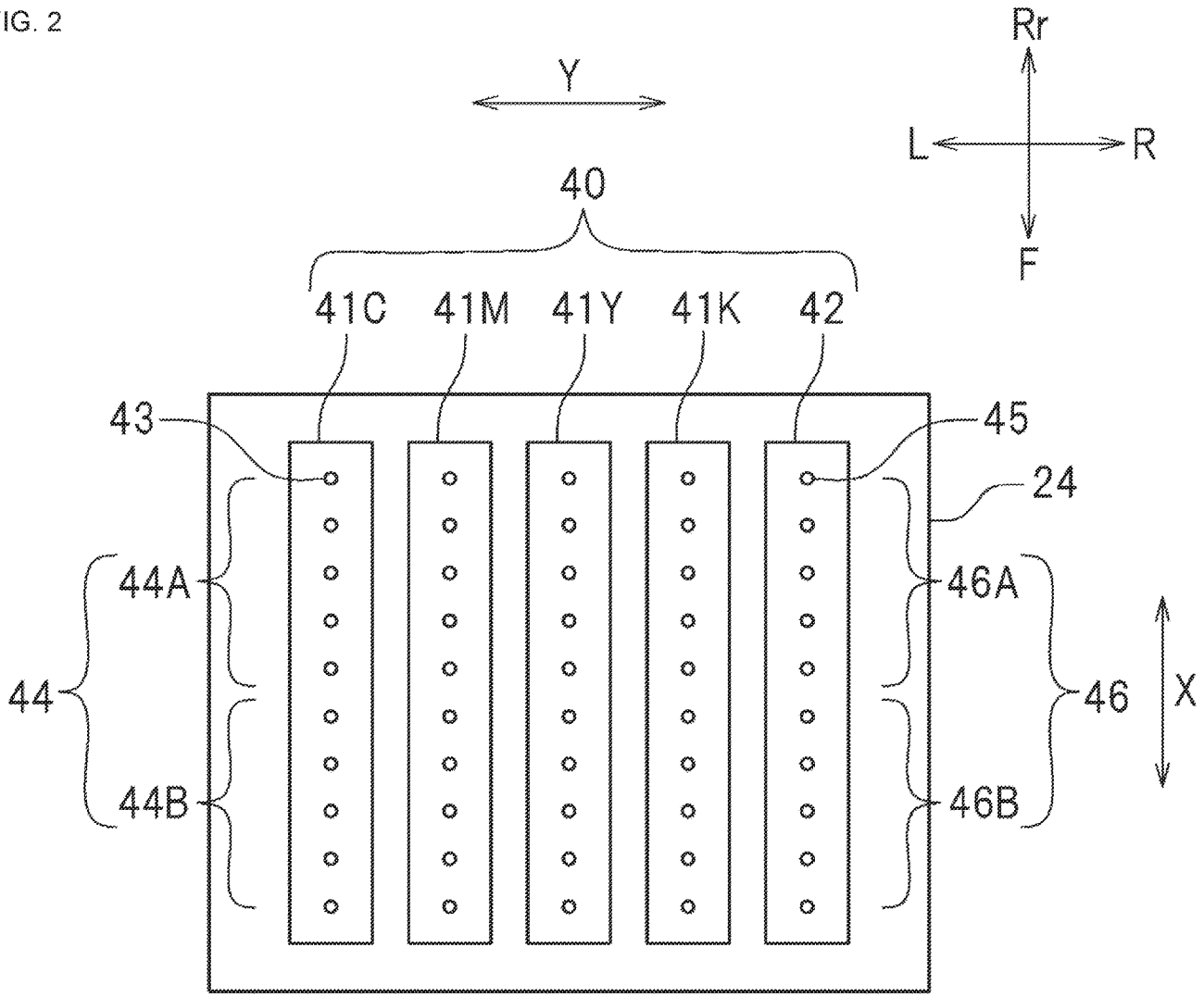
FIG. 2 is a schematic diagram, illustrating the configuration of a bottom surface of a carriage according to the first preferred embodiment of the present invention.

FIG. 1 is a front view of a wide-format inkjet printer (which is hereinafter referred to as "printer") 10 according to a first preferred embodiment according to the present invention. FIG. 2 is a schematic diagram, illustrating the configuration of a surface (a bottom surface in this preferred embodiment) of a carriage 24 to be opposed to a recording medium 5. The printer 10 prints an image on a rolled recording medium 5 by moving the recording medium 5 sequentially forward (toward the downstream side in the sub-scanning direction X) and ejecting inks from ink heads 40 (refer to FIG. 2) that move in the main scanning direction Y.

The recording medium 5 is an object on which an image is printed. The recording medium 5 is not limited to particular media. The recording medium 5 may be a paper such as plain paper or inkjet printing paper, a transparent sheet such as one made from a resin or glass, or a sheet such as one made from a metal or rubber. In this preferred embodiment, the recording medium 5 is a transparent sheet.

As shown in FIG. 1, the printer 10 includes a printer main unit 10A and legs 11 that support the printer main unit 10A. The printer main unit 10A is elongated in the main scanning direction Y. The printer main unit 10A includes a guide rail 12, and the carriage 24 in engagement with the guide rail 12. The guide rail 12 extends in the main scanning direction Y. The guide rail 12 guides the movement of the carriage 24 in the main scanning direction Y. An endless belt 13 is fixed to the carriage 24. The belt 13 is entrained around a pulley 14A provided to the right of the guide rail 12 and a pulley 14B provided to the left of the guide rail 12. A carriage motor 15 is attached to the pulley 14A on the right side. The carriage motor 15 is electrically connected to a controller 30. The carriage motor 15 is controlled by the controller 30. When the carriage motor 15 is driven, the pulley 14A rotates and the belt 13 runs. Then, the carriage 24 moves in the main scanning direction Y along the guide rail 12. When the carriage 24 moves in the main scanning direction Y in this way, the ink heads 40 also move in the main scanning direction Y. In this preferred embodiment, the belt 13, the pulley 14A, the pulley 14B and the carriage motor 15 constitute one example of a movement mechanism that moves the carriage 24 and the ink heads 40 in the main scanning direction Y.

A platen 16 is located below the carriage 24. The platen 16 is elongated in the main scanning direction Y. The recording medium 5 is placed on the platen 16. Pinch rollers 17 that press the recording medium 5 down from above are provided above the platen 16. The pinch rollers 17 are located to the rear of the carriage 24. The platen 16 includes grid rollers 18. The grid rollers 18 are located immediately below the pinch rollers 17. The grid rollers 18 are located at positions facing the pinch rollers 17. The grid rollers 18 are coupled to a feed motor 22 (refer to FIG. 4). The grid rollers 18 are rotatable by a driving force of the feed motor 22. The feed motor 22 is electrically connected to the controller 30. The feed motor 22 is controlled by the controller 30. When the grid rollers 18 are rotated with the recording medium 5 held between the pinch rollers 17 and the grid rollers 18, the recording medium 5 is transported in the sub-scanning direction X. In this preferred embodiment, the pinch rollers 17, the grid rollers 18 and the feed motor 22 constitute one example of a transporter that moves the recording medium 5 in the sub-scanning direction X.

The printer 10 includes the ink heads 40. As shown in FIG. 2, the ink heads 40 are provided in the carriage 24. The ink heads 40 include a plurality of first ink heads 41C, 41M, 41Y and 41K and one second ink head 42. As shown in FIG. 2, the first ink heads 41C, 41M, 41Y and 41K and the second ink head 42 are aligned in the main scanning direction Y in the carriage 24.

Each of the plurality of first ink heads 41C, 41M, 41Y and 41K ejects a process color ink to form a color image. Each process color ink is one example of a first ink. In this preferred embodiment, the first ink head 41C ejects cyan ink. The first ink head 41M ejects magenta ink. The first ink head 41Y ejects yellow ink. The first ink head 41K ejects black ink. However, the number of the first ink heads is not limited to four, and the color tones of the process color inks are not at all limited.

As shown in FIG. 2, each of the plurality of first ink heads 41C, 41M, 41Y and 41K includes a plurality of nozzles 43 aligned in the sub-scanning direction X. In this preferred embodiment, the plurality of nozzles 43 is aligned in a line to define a nozzle array 44 in each of the first ink heads 41C, 41M, 41Y and 41K. However, the arrangement of the nozzles 43 is not at all limited. Each nozzle array 44 includes a first upstream side nozzle array 44A located on the upstream side in the sub-scanning direction X and a first downstream side nozzle array 44B located on the downstream side in the sub-scanning direction X. The nozzles 43 of the plurality of first ink heads 41C, 41M, 41Y and 41K are located at the same positions with respect to the sub-scanning direction X. While the number of nozzles 43 in the first upstream side nozzle array 44A and the number of nozzles 43 in the first downstream side nozzle array 44B are equal to each other in this preferred embodiment, this is not limitative.

In this preferred embodiment, the second ink head 42 ejects what is called a special color ink that changes the color tone or design of a color image. The special color ink constitutes one example of a second ink. Here, the second ink head 42 ejects white ink. While the number of the second ink head 42 is one in this preferred embodiment, this is not limitative. For example, the number of second ink heads 42 may be two or more. The color tone of the special color ink is not at all limited. For example, the second ink head 42 may eject a metallic ink such as silver ink or gold ink, or a transparent ink.

As shown in FIG. 2, the second ink head 42 includes a plurality of nozzles 45 aligned in the sub-scanning direction X. In this preferred embodiment, the plurality of nozzles 45 is aligned in a line to form a nozzle array 46 in the second ink head 42. However, the arrangement of the nozzles 45 is not at all limited. The nozzle array 46 includes a second upstream side nozzle array 46A located on the upstream side in the sub-scanning direction X and a second downstream side nozzle array 46B located on the downstream side in the sub-scanning direction X. While the number of nozzles 45 in the second upstream side nozzle array 46A and the number of nozzles 45 in the second downstream side nozzle array 46B are equal to each other in this preferred embodiment, this is not limitative. The nozzles 45 of the second ink head 42 are located at the same positions as the nozzles 45 of the first ink heads 41C, 41M, 41Y and 41K with respect to the sub-scanning direction X.

While each of the first ink heads 41C, 41M, 41Y and 41K and the second ink head 42 is shown to have ten nozzles 43 or 45 in FIG. 2, much more (for example, 300) nozzles 43 or 45 are preferably provided in reality. However, the number of nozzles 43 and 45 is not at all limited.

An actuator 47 (refer to FIGS. 8A and 8B) is provided in each of the first ink heads 41C, 41M, 41Y and 41K, and an actuator (refer also to FIGS. 8A and 8B) is provided in the second ink head 42. While the actuators 47 provided in the first ink heads 41C, 41M, 41Y and 41K and the actuator 48 provided in the second ink head 42 have the same mechanism, the actuators 47 provided in the first ink heads 41C, 41M, 41Y and 41K are referred to as "first actuators 47" and the actuator 48 provided in the second ink head 42 is referred to as "second actuator 48" for convenience sake. Each first actuator 47 according to this preferred embodiment includes pressure chambers 47A and piezoelectric elements 47B. An ink is stored in the pressure chambers 47A. The piezoelectric elements 47B are provided in contact with the pressure chambers 47A, and are displaced to contract the pressure chambers 47A when driven. The second actuator 48 also has the same mechanism as the first actuators 47, and includes pressure chambers 48A and piezoelectric elements 48B. The first actuators 47 and the second actuator 48 are electrically connected to the controller 30. The first actuators 47 and the second actuator 48 are controlled by the controller 30. When the first actuators 47 and the second actuator 48 are driven, the inks are ejected from the nozzles 43 of the first ink heads 41C, 41M, 41Y and 41K and the nozzles 45 of the second ink head 42 onto the recording medium 5.

Each of the first ink heads 41C, 41M, 41Y and 41K and the second ink head 42 is communicated with an ink cartridge (not shown) via an ink supply passage (not shown). The ink cartridges are detachably disposed in a right end portion of the printer main unit 10A, for example. The materials of the inks are not at all limited, and various types of materials conventionally used as materials of inks for inkjet printers can be used. The inks may be solvent-based pigment inks, aqueous pigment inks, aqueous dye inks, or ultraviolet curable pigment inks, which cures when exposed to ultraviolet radiation, for example. In this preferred embodiment, the printer 10 includes an ultraviolet irradiator as an ink curing unit for curable inks, and the inks are therefore ultraviolet curable pigment inks.

Figure 3:
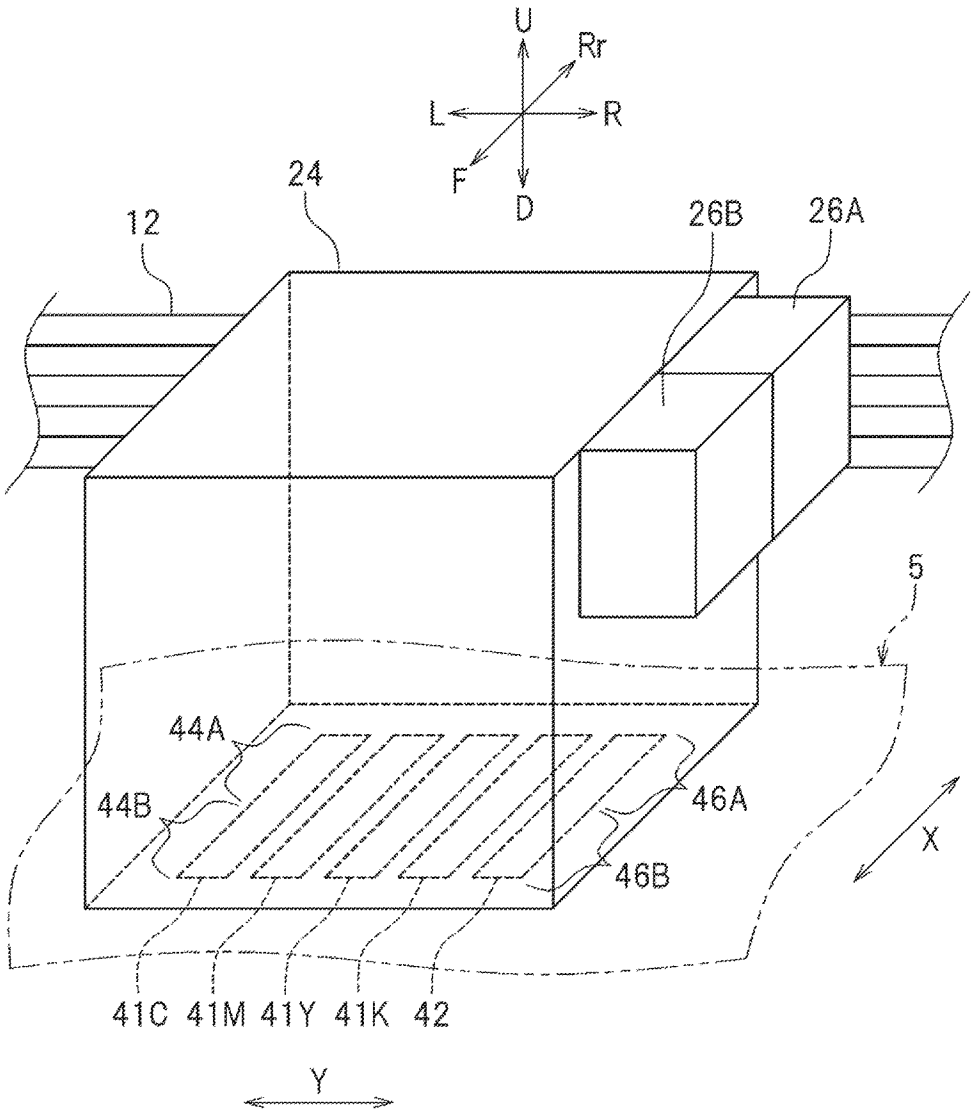
FIG. 3 is a perspective view, illustrating the carriage according to the first preferred embodiment of the present invention and its surroundings.

FIG. 3 is a perspective view, illustrating the carriage and its surroundings. As shown in FIG. 3, the printer 10 according to this preferred embodiment includes two ultraviolet irradiators, a first ultraviolet irradiator 26A and a second ultraviolet irradiator 26B. The first ultraviolet irradiator 26A and the second ultraviolet irradiator 26B are mounted on the carriage 24. Each of the first ultraviolet irradiator 26A and the second ultraviolet irradiator 26B includes a light source that emits ultraviolet radiation with frequencies that cure the inks, and is installed in such a position that it can emit ultraviolet radiation to a predetermined position on the recording medium 5. The light source is an ultraviolet irradiation LED, for example. The first ultraviolet irradiator 26A is located on the upstream side in the sub-scanning direction X on the carriage 24. In other words, the first ultraviolet irradiator 26A is aligned with the first upstream side nozzle arrays 44A and the second upstream side nozzle array 46A in the main scanning direction Y. The first ultraviolet irradiator 26A is installed such that it emits ultraviolet radiation to a position directly underneath it. The second ultraviolet irradiator 26B is located on the downstream side in the sub-scanning direction X on the carriage 24. In other words, the second ultraviolet irradiator 26B is aligned with the first downstream side nozzle arrays 44B and the second downstream side nozzle array 46B in the main scanning direction Y. The second ultraviolet irradiator 26B is also installed such that it emits ultraviolet radiation to a position directly underneath it. The first ultraviolet irradiator 26A and the second ultraviolet irradiator 26B may be structurally integrated with each other as long as they are controlled separately.

Figure 4:
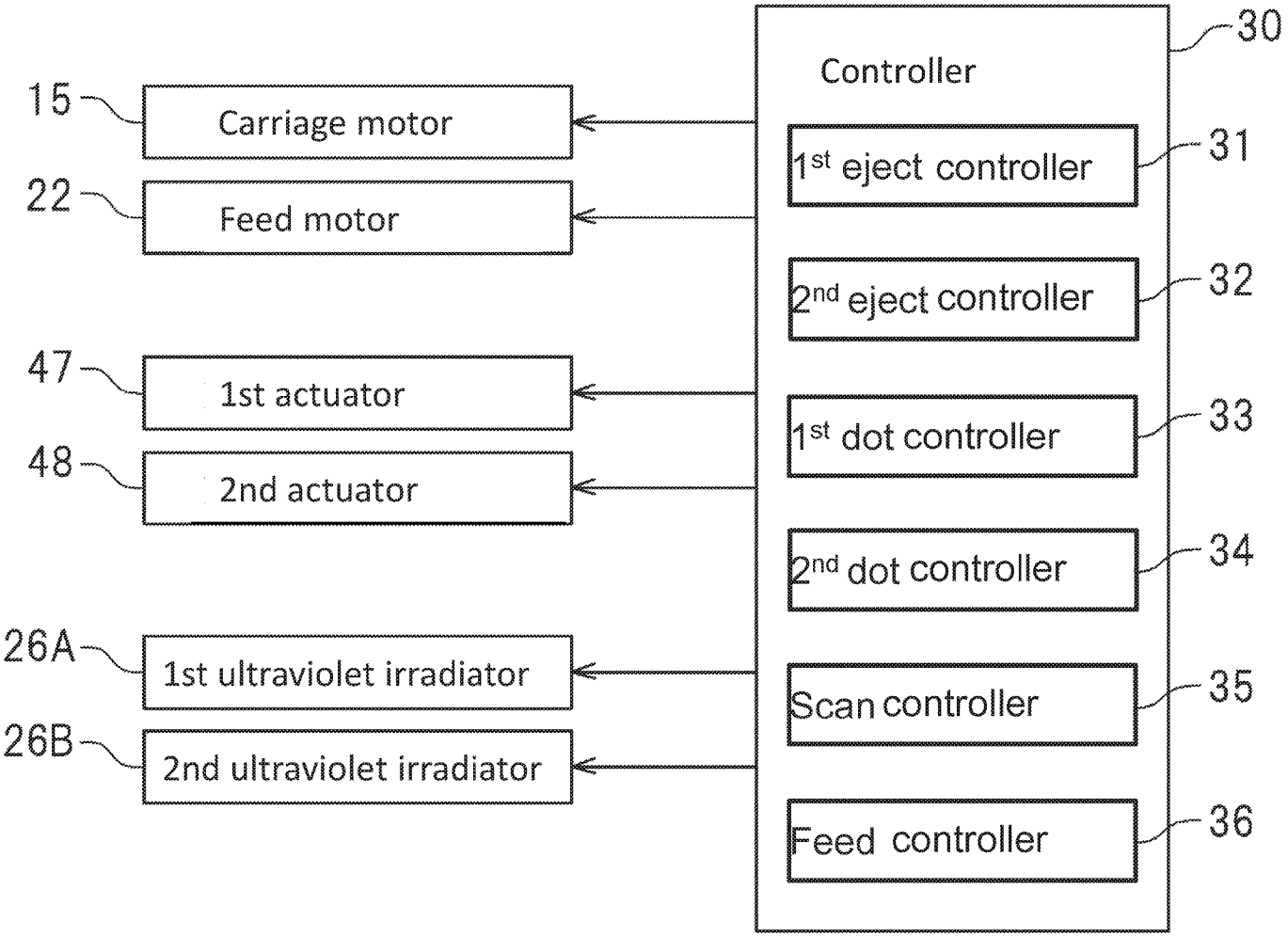
FIG. 4 is a block diagram of the printer according to the first preferred embodiment of the present invention.

As shown in FIG. 1, an operation panel 20 is provided at a right end portion of the printer main unit 10A. The operation panel 20 includes a display on which the device states are displayed, input keys that are operated by the user, and so on. The controller 30, which controls various operations of the printer 10, is housed inside the operation panel 20. FIG. 4 is a block diagram of the printer 10 according to this preferred embodiment. As shown in FIG. 4, the controller 30 is communicably connected to the feed motor 22, the carriage motor 15, the first actuator 47, the second actuator 48, the first ultraviolet irradiator 26A and the second ultraviolet irradiator 26B, and is configured or programmed to control these elements. The controller 30 is configured or programmed to include a first ejection controller 31, a second ejection controller 32, a first dot controller 33, a second dot controller 34, a scan controller 35, and a feed controller 36.

The controller 30 may have any configuration. For example, the controller 30 may be a microcomputer. The microcomputer may have any hardware configuration, but may include, for example, an interface (I/F) through which it receives print data and so on from an external device such as a host computer, a central processing unit (CPU) that executes instructions from control programs, a ROM (read only memory) in which programs that are executed by the CPU are stored, a RAM (random access memory) that is used as a working area in which the programs are developed, and a storage device, such as a memory, in which the program and various data are stored. The controller 30 is not necessarily provided in the printer main unit 10A, and may be a computer or the like that is disposed outside the printer main unit 10A and communicably connected to the printer main unit 10A via a wired or wireless connection, for example.

The first ejection controller 31 causes the nozzles 43 of the first upstream side nozzle arrays 44A to eject the process color inks onto the recording medium 5. The first ejection controller 31 is connected to the first actuators 47 (refer to FIG. 4 and FIGS. 8A and 8B), and causes the nozzles 43 of the first upstream side nozzle arrays 44A to eject the process color inks.

The second ejection controller 32 causes the nozzles 45 of the second downstream side nozzle array 46B to eject the special color ink over the process color inks that have been ejected onto the recording medium 5. In this preferred embodiment, the special color ink is white ink. The second ejection controller 32 is connected to the second actuator 48 (refer to FIG. 4 and FIGS. 8A and 8B), and causes the nozzles 45 of the second downstream side nozzle array 46B to eject the white ink.

The first dot controller 33 controls the dot size after curing of the process color inks. In this preferred embodiment, the first dot controller 33 is connected to the first ultraviolet irradiator 26A, and causes the first ultraviolet irradiator 26A to emit ultraviolet radiation with a predetermined intensity at predetermined times. The first dot controller 33 controls the dot size after curing of the process color inks by controlling the irradiation of the ultraviolet radiation.

The second dot controller 34 controls the dot size after curing of the special color ink. In this preferred embodiment, the second dot controller 34 is connected to the second ultraviolet irradiator 26B, and causes the second ultraviolet irradiator 26B to emit ultraviolet radiation with a predetermined intensity at predetermined times. The second dot controller 34 controls the dot size after curing of the special color ink by controlling the irradiation of the ultraviolet radiation.

The scan controller 35 is connected to the carriage motor 15, and controls driving of the carriage motor 15. The scan controller 35 controls the movement of the carriage 24 in the main scanning direction Y via control of the carriage motor 15.

The feed controller 36 is connected to the feed motor 22 and controls driving of the feed motor 22. The feed controller 36 controls transportation of the recording medium 5, which is placed on the platen 16 and transported in the sub-scanning direction X by the grid rollers 18, via control of the feed motor 22 to drive the grid rollers 18.

In normal printing using only the process color inks, the feed controller 36 of the controller 30 controls the feed motor 22 so that the recording medium 5 is able to be sequentially fed forward (toward the downstream side in the sub-scanning direction X). The scan controller 35 drives the carriage motor 15 to move the carriage 24 in the main scanning direction Y, and the first ejection controller 31 drives the first actuators 47 to cause the first ink heads 41C, 41M, 41Y and 41K to eject the process color inks onto the print side of the recording medium 5. After the ejection of the process color inks, the first dot controller 33 causes the first ultraviolet irradiator 26A and the second ultraviolet irradiator 26B to emit ultraviolet radiation to cure the process color inks. The scan controller 35 moves the carriage 24 in the main scanning direction Y once or a plurality of times before the recording medium 5 is fed forward once by the feed controller 36, for example.

The printer 10 according to this preferred embodiment is also configured or programmed to be able to perform overprinting in which an upper print layer is formed over a lower print layer as well as the normal printing as described above. In overprinting, an image is first printed with the process color inks on the recording medium 5, for example. Then, the process color inks are cured. Then, printing is performed over the cured process color inks using a special color ink to provide a visual effect. After that, the ejected special color ink is cured. The purpose of overprinting is to provide the image with a specific visual effect. In this preferred embodiment, because the recording medium 5 is a transparent sheet, the purpose is to provide the image with a ground color (white).

However, as with the printer 10 according to this preferred embodiment, inkjet printers of this type generally have only one or a few ink heads that eject a special color ink. When the number of ink heads for a special color ink is small, the special color ink may not cover the layer of process color inks sufficiently to provide a desired visual effect. For example, when printing is performed with a base color (white) ink over an image formed using process color inks on a transparent recording medium as in this preferred embodiment, sufficient light shielding cannot be achieved if the white ink layer does not cover the process color ink layer completely. When the special color ink layer does not cover the lower image layer sufficiently, the aimed visual effect may not be obtained. Such a reduced visual effect can take place widely in overprinting as well as in printing in a ground color on a transparent recording medium.

Thus, the controller 30 of the printer 10 according to this preferred embodiment includes the first dot controller 33, which controls the dot size after curing of the process color inks ejected onto the recording medium 5 to a predetermined "first dot size," and the second dot controller 34, which controls the dot size after curing of the special color ink ejected over the process color inks to a "second dot size" that is greater than the "first dot size." In this preferred embodiment, the process color inks are cyan, magenta, black and yellow process color inks, and the special color ink is white ink.

The above inkjet printer ensures that the image layer is covered with a layer of a special color ink by making the dot size of the special color ink, which forms the upper layer, greater than the dot size of the process color inks, which form the lower layer. This configuration reliably enables the special color ink to provide the image with an expected visual effect. In addition, the above inkjet printer is able to achieve the above advantageous effects without increasing the number of the nozzles in the second downstream side nozzle array 46B or increasing the number of times of ejection from the nozzles in the second downstream side nozzle array 46B. Thus, there is no possibility that the printing efficiency is lowered.

Figure 5A:
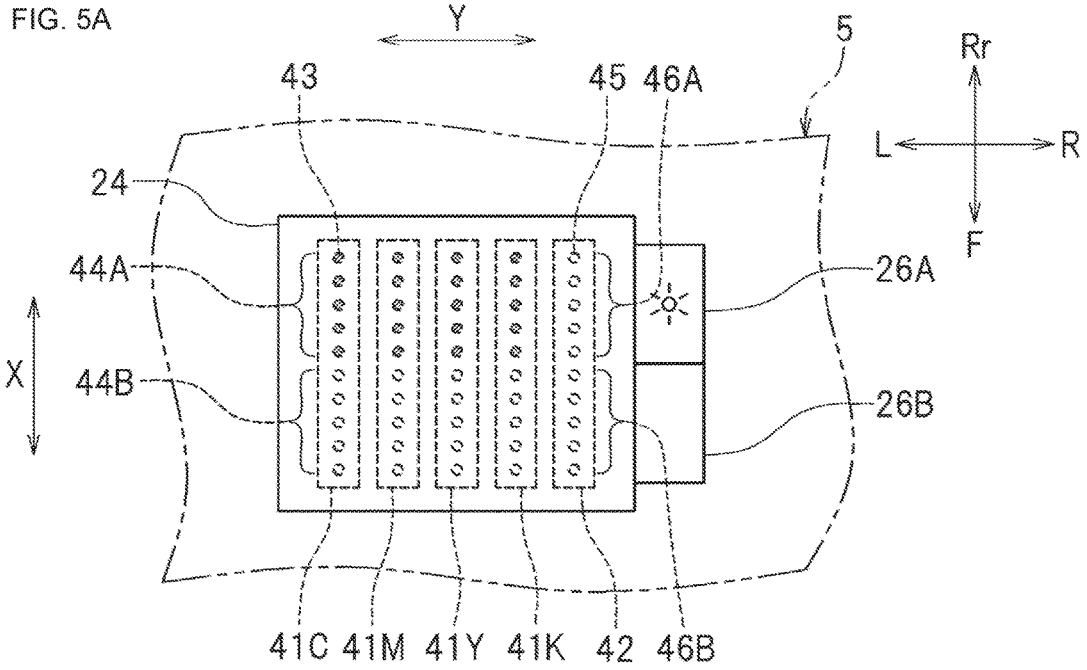
FIGS. 5A and 5B are schematic diagrams, as viewed from above, of the carriage and its surroundings during overprinting.
Figure 5B:
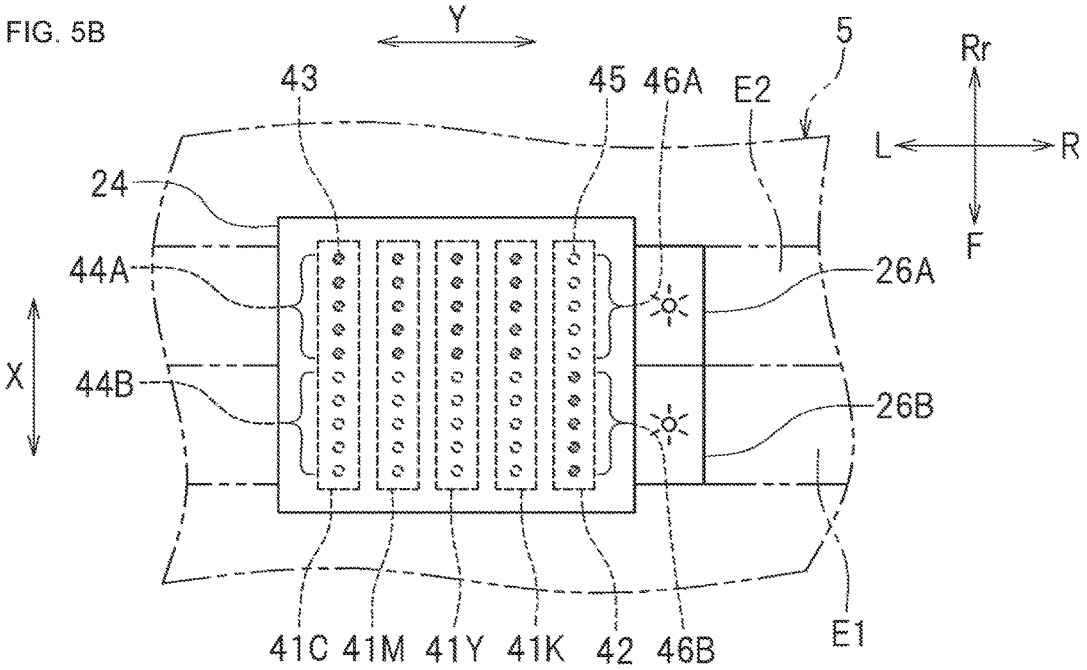

In the following, a continuous overprinting process is described. FIGS. 5A and 5B is a schematic diagram, as viewed from above, illustrating the carriage 24 and its surroundings during continuous overprinting. In FIGS. 5A and 5B, the hatching provided in some of the nozzles 43 and 45 indicates that the relevant nozzle is ejecting ink. The illuminating mark on the first ultraviolet irradiator 26A and the second ultraviolet irradiator 26B indicates that the relevant ultraviolet irradiator is emitting ultraviolet radiation.

FIG. 5A is a diagram illustrating a state where process color inks are being ejected and cured. In other words, FIG. 5A is a diagram illustrating a state where a lower layer is being printed. When a lower layer is printed, the process color inks are ejected from the nozzles 43 of the first upstream side nozzle arrays 44A. In the state shown in FIG. 5A, the carriage 24 is performing printing of the lower layer while moving in the main scanning direction Y.

The process color inks ejected onto the recording medium 5 are cured almost simultaneously with the ejection in the same path as that along which the process color inks are ejected. In FIG. 5A, the first ultraviolet irradiator 26A is irradiating the process color inks of the lower layer with ultraviolet radiation. Because the first ultraviolet irradiator 26A is aligned with the first upstream side nozzle arrays 44A and the second upstream side nozzle arrays 46A, only the process color inks ejected from the nozzles 43 of the first upstream side nozzle arrays 44A are irradiated with ultraviolet radiation. The irradiation of ultraviolet radiation may be exceptionally carried out in a path different from that along which the process color inks are ejected.

After the irradiation of the process color inks with ultraviolet radiation, the feed controller 36 drives the feed motor 22 to move the recording medium 5 forward once. The movement distance at this time is equal to the length in the sub-scanning direction X of the first upstream side nozzle arrays 44A. After the recording medium 5 is moved, the second ejection controller 32 causes the nozzles 45 of the second downstream side nozzle array 46B to eject the white ink and causes, after the ejection, the second ultraviolet irradiator 26B to emit ultraviolet radiation. The second ultraviolet irradiator 26B irradiates the white ink ejected over the lower layer with ultraviolet radiation. FIG. 5B is a diagram illustrating ejection of the white ink from the nozzles 45 in the second downstream side nozzle array 46B and emission of ultraviolet radiation from the second ultraviolet irradiator 26B. In FIG. 5B, the region denoted by a reference numeral E1 represents a cured region E1 where curing of the process color inks of the lower layer has been completed in the previous process. In the state shown in FIG. 5B, the nozzles 45 in the second downstream side nozzle array 46B are ejecting the white ink to the region E1, and the second ultraviolet irradiator 26B is curing the white ink almost simultaneously. At this time, the process color inks are being ejected from the nozzles 43 of the second upstream side nozzle arrays 44A to a region E2 next to the cured region E1 (on the upstream side in the sub-scanning direction X), and the first ultraviolet irradiator 26A is curing the ejected process color inks. The printer 10 according to this preferred embodiment, in which the positions of the first upstream side nozzle arrays 44A and the second downstream side nozzle array 46B are offset in the sub-scanning direction X as described above, is able to perform overprinting continuously.

In the printing process in the above continuous overprinting, the first dot controller 33 and the second dot controller 34 control the first ultraviolet irradiator 26A and the second ultraviolet irradiator 26B, respectively, so that the dot size after curing of the white ink can be greater than the dot size after curing of the process color inks. In this preferred embodiment, all the nozzles eject ink dots with the same size. In other words, all the ink dots have almost the same volume. In addition, the nozzles 43 and the nozzles 45 are arranged at the same pitch, and the ink dots ejected from the nozzles 43 and the ink dots ejected from the nozzles 45 are therefore the same in number per unit area.

The dot sizes after curing of the process color inks and special color ink are primarily adjusted by the time period between the ejection of ink and the start of curing. In this preferred embodiment, the dot sizes after curing of the process color inks and special color ink are adjusted between the ejection of each ink and the start of emission of ultraviolet radiation. Thus, in the following, the time period between the ejection of process color inks and the start of emission of ultraviolet radiation is referred to as "first curing start time," and the time period between the ejection of a special color ink and the start of emission of ultraviolet radiation is referred to as "second curing start time." The first dot controller 33 causes the first ultraviolet irradiator 26A to start curing of the process color inks when a predetermined "first curing start time" has passed after the ejection of the process color inks. The second dot controller 34 causes the second ultraviolet irradiator 26B to start curing of the special color ink when a predetermined "second curing start time" has passed after the ejection of the special color ink. The "second curing start time" is set longer than the "first curing start time." Because the "second curing start time" is set longer than the "first curing start time," the curing of the special color ink (white ink) is started later after the ejection than the curing of the process color inks. Because the time period between ejection and curing is longer, the special color ink spreads flat and is cured with a relatively larger dot size. In contrast, because the time period between ejection and curing is shorter, the process color inks do not have time to spread flat and are cured with a relatively smaller dot size.

The dot sizes after curing of the process color inks and special color ink are also adjusted by the intensity of ultraviolet radiation. An ultraviolet curable ink cures faster when irradiated with stronger ultraviolet radiation. The first dot controller 33 controls the first ultraviolet irradiator 26A so that it can emit ultraviolet radiation with a "first intensity," and the second dot controller 34 controls the second ultraviolet irradiator 26A so that it can emit ultraviolet radiation with a "second intensity." The "second intensity" is set lower than the "first intensity." By setting the intensity of ultraviolet radiation used to cure the special color ink lower than that of ultraviolet radiation used to cure the process color inks, the special color ink is cured slower than the process color inks. Because of the slower curing speed, the special color ink spreads flat before being cured and is cured with a relatively larger dot size. While the ink dot sizes are adjusted by controlling both the curing start time and the intensities of ultraviolet irradiation in this preferred embodiment, the ink dot sizes may be adjusted by controlling either one of these.

Figure 6:
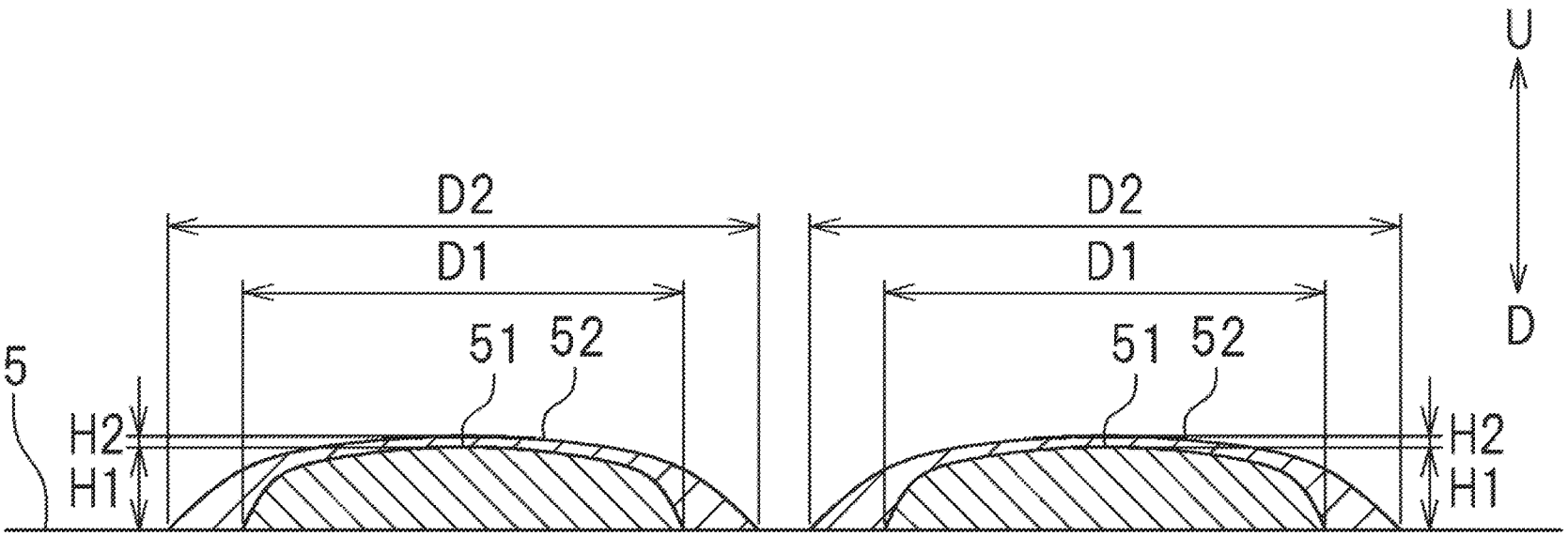
FIG. 6 is a schematic diagram, as viewed from a side, of a process color ink and a special color ink on a recording medium.

FIG. 6 is a schematic diagram, as viewed from a side, of a process color ink and a white ink on the recording medium 5. In FIG. 6, a process color ink 51 is present on a surface of the recording medium 5 and has a dot size (diameter) D1. The dot size D1 corresponds to the "first dot size" in this preferred embodiment. The dots of the process color ink 51 have a height of H1. On the other hand, dots of a white ink 52 have a dot size (diameter) D2. The dot size D2 corresponds to the "second dot size" in this preferred embodiment. The dots of the white ink 52 have a height of H2. The process color ink 51 and the white ink 52 have the same set dot size and therefore have almost the same dot volume. However, the height H2 of the dots of the white ink 52, which were cured after spreading flat, is lower than the height H1 of the dots of the process color ink 51, which were cured before spreading so much, and the dot size D2 of the white ink 52 is larger than the dot size D1 of the process color ink 51. Because the dot size D2 of the white ink 52 is larger than the dot size D1 of the process color ink 51, the dots of the process color ink 51 are completely covered with the dots of the white ink 52. Thus, the printed matter obtains a desired visual effect.

The dot size control as described above may have variation depending on the ink types. For example, when the special color ink 52 wets more readily (has a smaller contact angle on) the recording medium 5 than the process color ink 51, the process color ink 51 and the special color ink 52 may be cured under the same conditions. When the process color ink 51 and the special color ink 52 are cured under the same conditions, the resulting dot size D2 of the special color ink 52 becomes larger than the dot size D1 of the process color ink 51.

As described above, the printer 10 according to this preferred embodiment ensures, in overprinting in which lower and upper layers are printed on top of each other, that the layer of a special color ink that forms the upper layer completely covers an image layer that forms the lower layer. Thus, a desired visual effect is achieved.

Second Preferred Embodiment

A second preferred embodiment of the present invention is a preferred embodiment in which heaters are provided in place of the ultraviolet irradiators as ink curing units. Thus, the inks in the second preferred embodiment are inks that are cured by heat or inks that undergo accelerated curing when exposed to heat. The printer 10 according to the second preferred embodiment is identical with the printer 10 according to the first preferred embodiment except for having heaters in place of the ultraviolet irradiators and some differences in control. Thus, in the following description of the second preferred embodiment, the same members as those of the first preferred embodiment are denoted by the same reference numerals or symbols and redundant description is omitted or simplified. This also applies to the description of a third preferred embodiment of the present invention.

Figure 7:
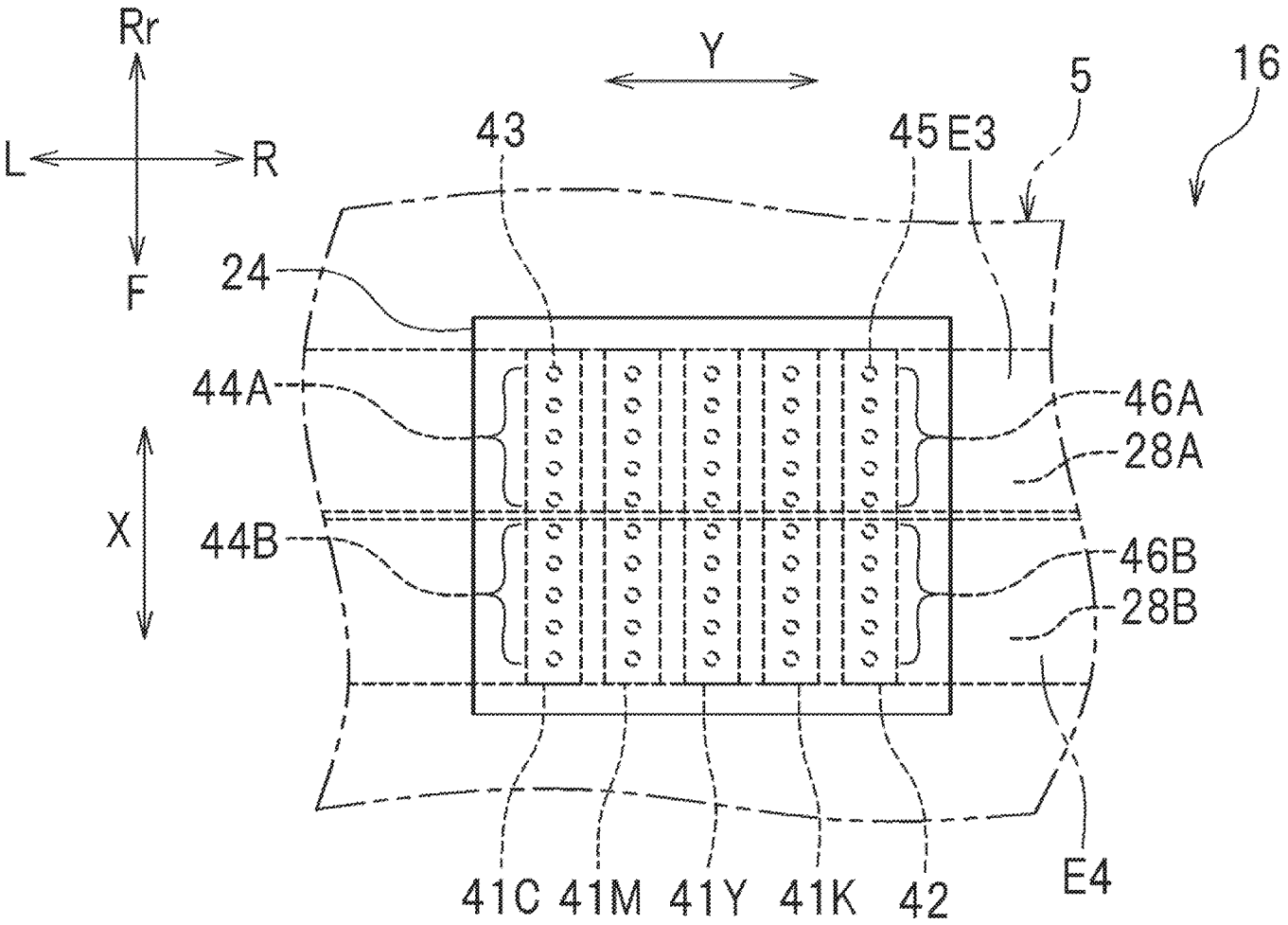
FIG. 7 is a schematic diagram, as viewed from above, of a platen according to a second preferred embodiment of the present invention.

FIG. 7 is a schematic diagram, as viewed from above, of the top of the platen 16. Above the platen 16, the carriage 24 is in engagement with the guide rail 12 (not shown in FIG. 7) to move in the main scanning direction Y. The recording medium 5 is mounted on the platen 16. A first heater 28A and a second heater 28B are attached to a lower surface of the platen 16 (the surface thereof opposite to the "upper surface" on which the recording medium 5 is mounted). The first heater 28A is located in the same position as the first upstream side nozzle arrays 44A and the second upstream side nozzle array 46A with respect to the sub-scanning direction X. Although not shown, the first heater 28A has a width in the main scanning direction Y that is larger than that of the recording medium 5 so that it can heat the recording medium 5 over its entire width. The second heater 28B is located in the same position as the first downstream side nozzle arrays 44B and the second downstream side nozzle array 46B with respect to the sub-scanning direction X. Although not shown, the second heater 28B also has a width in the main scanning direction Y that is larger than that of the recording medium 5 so that it can heat the recording medium 5 over its entire width. In other words, the first heater 28A and the second heater 28B are arranged side by side in the sub-scanning direction X with the first heater 28A located on the upstream side in the sub-scanning direction X. In overprinting, the first heater 28A heats a region E3 onto which the process color inks are ejected from the nozzles 43 of the first upstream side nozzle arrays 44A to cure the process color inks. The second heater 28B heats a region E4 onto which the special color ink is ejected from the nozzles 45 of the second downstream side nozzle array 46B to cure the special color ink.

The first heater 28A and the second heater 28B are configured to maintain a predetermined temperature under the control of the first dot controller 33 and the second dot controller 34, respectively. The first heater 28A is connected to the first dot controller 33, and controlled at a predetermined temperature set by the first dot controller 33 (which is hereinafter referred to as "first temperature"). The second heater 28B is connected to the second dot controller 34, and controlled at a predetermined temperature set by the second dot controller 34 (which is hereinafter referred to as "second temperature").

In the printer 10 according to this preferred embodiment, the curing speeds of the inks are controlled by adjusting the temperatures of the first heater 28A and the second heater 28B. More specifically, the curing speed of the process color inks is controlled by the temperature of the first heater 28A (="first temperature") and the curing speed of the special color ink is controlled by the temperature of the second heater 28B (="second temperature").

A heat-curable ink generally cures faster as the temperature is higher as long as the temperature is within an appropriate temperature range for each type of ink. As described in the description of the first preferred embodiment, the ink has a smaller dot size as the curing speed is higher and has a larger dot size as the curing speed is lower. Here, the "second temperature" is set lower than the "first temperature" so that the dot size of the special color ink can be larger than the dot size of the process color inks.

In a continuous overprinting process, the recording medium 5 is moved intermittently to the downstream side in the sub-scanning direction X (toward the front F of the printer 10) whereas the positional relationship in the sub-scanning direction X between the first and second heaters 28A and 28B and the ink heads 40 in the carriage 24 does not change. Thus, regardless of the progress of printing (the movement of the recording medium 5), the region E3, into which the process color inks are ejected, is maintained at the "first temperature" by the first heater 28A, and the region E4, into which the special color ink is ejected, is maintained at the "second temperature" by the second heater 28B. As described above, the printer 10 according to this preferred embodiment keeps the dot size of the special color ink larger than the dot size of the process color inks at any time during printing.

In addition, in the printer 10 according to this preferred embodiment, the time period between the ejection of the process color inks and the ejection of the special color ink is registered in the second ejection controller 32. The second ejection controller 32 controls the second actuator 48 for the second downstream side nozzle array 46B so that the registered time period can pass before the special color ink is ejected over the process color inks. More specifically, when the special color ink wets the recording medium 5 more easily than the process color inks, a period shorter than that which is set when the special color ink wets the recording medium 5 equally or less readily than the process color inks is set in the second ejection controller 32. When the process color inks wet the recording medium 5 more readily than the special color ink, the process color inks tend to have a larger dot size than the special color ink. In this case, the time period between the ejection of the process color inks and the ejection of the special color ink is shortened to hasten the ejection of the special color ink to form an upper layer. When the ejection of the special color ink is hastened, the special color ink is ejected over the process color inks before the process color inks are cured completely (before the process color inks spread flat). This configuration further ensures that the process color inks are covered with the special color ink.

While the first heater 28A and the second heater 28B preferably are located on a lower surface of the platen 16 in the printer 10 according to this preferred embodiment, the first heater 28A and the second heater 28B may not necessarily be located on a lower surface of the platen 16. For example, the first heater 28A and the second heater 28B may be mounted on the carriage 24 as in the case of the ultraviolet irradiators in the first preferred embodiment. When the first heater 28A and the second heater 28B are mounted on the carriage 24, any portion of the recording medium that needs heating can be heated when necessary, and the difference between the "first temperature" and the "second temperature" can be made easily.

Third Preferred Embodiment

A third preferred embodiment of the present invention is a preferred embodiment in which the dot size (dot volume) is changed between the process color inks and the special color ink. In the printer 10 according to the third preferred embodiment, a first actuator 47 is provided in each of the first ink heads 41C to 41K, and a second actuator 48 is provided in the second ink head 42. The first dot controller 33 is set to send a "first control signal" that causes the first actuators 47 to form ink dots with a "first volume," and the second dot controller 34 is set to send a "second control signal" that causes the second actuator 48 to form ink dots with a "second volume" which is greater than the "first volume." In other words, settings are made such that the dot size of the special color ink is larger than the dot size of the process color inks. Because the dots of the special color ink is formed larger in size than the dots of the process color inks, the image formed by the process color inks is reliably covered with the special color ink.

Figure 8A:
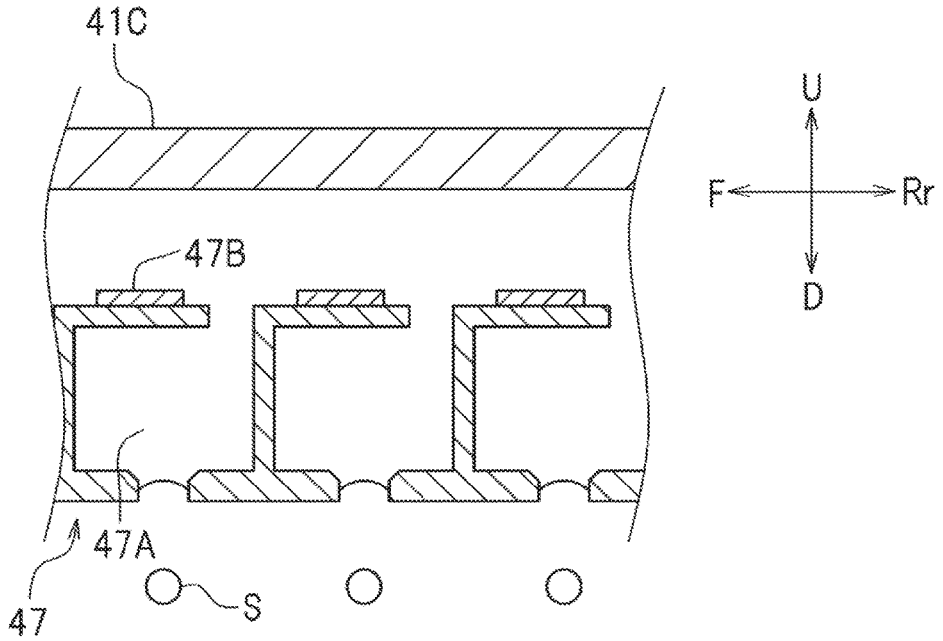
FIGS. 8A and 8B are schematic diagrams, illustrating the internal structure of an ink head.
Figure 8B:
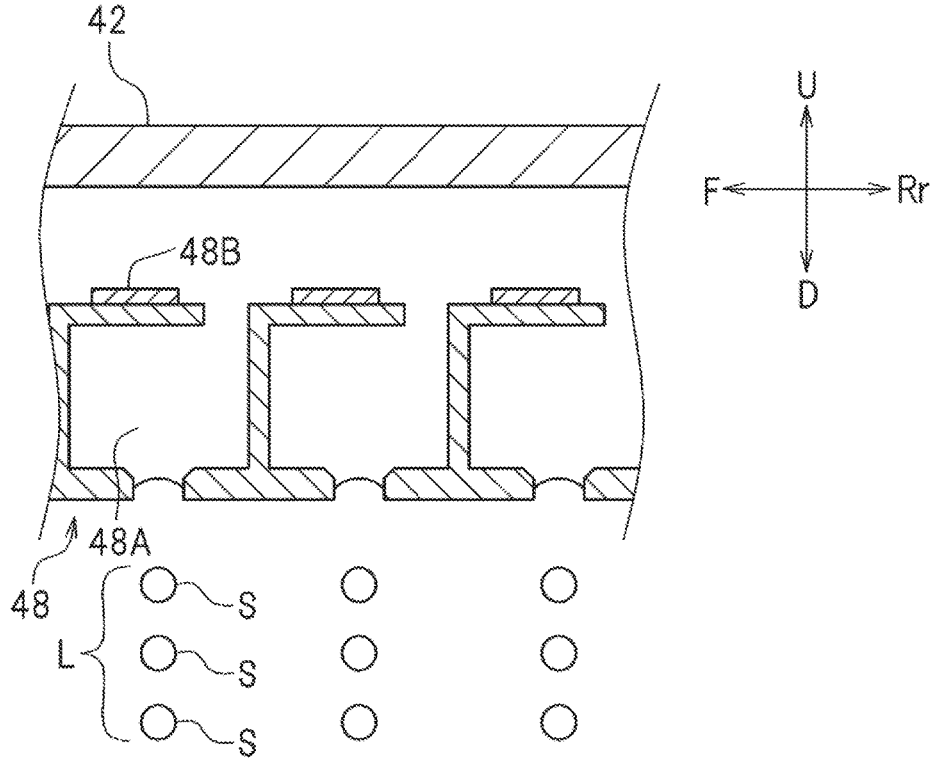

FIGS. 8A and 8B are schematic diagrams illustrating the internal structure of an ink head 40. FIG. 8A is a vertical cross-sectional view illustrating the internal structure of the ink heads 41C among the first ink heads. FIG. 8B is a vertical cross-sectional view illustrating the internal structure of the second ink head 42. As described above, the first ink head 41C includes the first actuator 47, and the second ink head 42 includes the second actuator 48.

The first actuator 47 and the second actuator 48 according to this preferred embodiment control the dot size of the ink to be ejected based on a control signal sent from the first dot controller 33 and the second dot controller 34, respectively. Specifically, the first actuator 47 and the second actuator 48 are configured or programmed to be able to select from three dot sizes S, M and L, for example. Among them, the S size is the basic dot size with the smallest volume. The medium dot size next to the S size is the M size. The M size has twice the volume of the S size, for example. The dot size with the largest volume is the L size. The L size has three times the volume of the S size, for example. While there are three dot sizes in this preferred embodiment, the number of dot sizes may be four or more, or two. The size differences are not necessarily two and three times greater.

The first dot controller 33 sends a "first control signal" that causes the first actuator 47 to eject S size ink dots, for example. FIG. 8A shows a state where S size ink dots S are being ejected from the first ink head 41C. The ink dots S are ejected every time the pressure chambers 47A are contracted by displacement of the piezoelectric elements 47B, which are provided in contact with the pressure chambers 47A. In other words, the ink dots S have a volume that is equal to the decrease in volume of the pressure chambers 47A per contraction.

The second dot controller 34 sends a "second control signal" that causes the second actuator 48 to eject L size ink dots, for example. FIG. 8B shows a state where L size ink dots L are being ejected from the second ink head 42. The ink is ejected according to the same principle as that in the first ink head 41C. In FIG. 8B, the second actuator 48 is ejecting three ink dots S per nozzle. This is achieved by carrying out three ejections at very short time intervals. Because the time intervals between the three ejections are very short, the three ink dots S reach almost the same point regardless of the fact that the carriage 24 is moving. Because three ink dots S reach the same point, an ink dot L with a volume three times that of the ink dot S is formed.

In this way, the second actuator 48 forms ink dots larger in size than those formed by the first actuator 47. In other words, the special color ink can have a larger dot size than the process color inks. This configuration ensures that the special color ink covers the image to provide a desired visual effect.

While the dot size of the inks that are ejected to form a lower layer and the dot size of the ink that is ejected to form an upper layer are set to different sizes in the above preferred embodiment, a volume difference may be made between ink dots with the same set size. In other words, the first actuator 47 may be configured to eject ink dots larger in volume than those ejected by the second actuator 48 for the same S size, for example. For example, in the case of an ink head that can select from three dot sizes S, M and L, the same applies to the M size and L size. The above method can also enable the dot size of the special color ink to be formed larger than the dot size of the process color inks to ensure that the image is covered with the special color ink.

Preferred embodiments of the present invention have been described in the foregoing. However, each of the above preferred embodiments is shown for illustrative purposes only and the present invention can be implemented in various different ways.

For example, the printer 10 according to a preferred embodiment of the present invention may be configured such that the special color ink has a higher ink dot density than the process color inks. The term "ink dot density" used herein refers to the number of ink dots per unit area of printed region. One exemplary method for forming ink dots of the special color ink at a higher density is to increase the number of paths along which the special color ink is ejected. Alternatively, the pitch of the nozzles 45 in the second downstream side nozzle array 46B may be reduced or the nozzles 45 may be increased into two or more arrays. When the ink dots of the special color ink are formed at a higher density than the ink dots of the process color inks in overprinting as described above, the process color inks can be covered with the special color ink more reliably and a desired visual effect can be achieved.

While process color inks are ejected to form a lower layer and a special color ink is ejected to form an upper layer in some of the above preferred embodiments of the present invention, a special color ink may be ejected to form a lower layer and process color inks may be ejected to form an upper layer.

In some of the above preferred embodiments, the inks are preferably ejected by changing the volume of pressure chambers by displacement of piezoelectric elements, i.e., a piezoelectric driving method. However, the first actuator 47 and the second actuator 48 according to a preferred embodiment of the present invention may be implemented by any of various continuous systems such as binary deflection systems and continuous deflection systems and various on-demand systems such as thermal systems. The systems for the actuators according to preferred embodiments of the present invention are not limited.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An inkjet printer comprising:

a first ink head that ejects a color ink on a recording medium;

a second ink head that ejects a white ink on the color ink;

a transporter that transports the recording medium from an upstream side to a downstream side in a sub-scanning direction;

a carriage that moves the first ink head and the second ink head in a main scanning direction that is perpendicular or substantially perpendicular to the sub-scanning direction;

a light emitter that emits light to cure the color ink ejected onto the recording medium and the white ink ejected onto the color ink; and a controller that controls the first ink head, the second ink head, the transporter, the carriage and the light emitter to cause the light emitter to emit light to the color ink after waiting a first time period from when the color ink has been ejected onto the recording medium and to cause the light emitter to emit light to the white ink after waiting a second time period from when the white ink has been ejected onto the color ink; wherein the first time period is less than the second time period;

the first ink head includes a first upstream side nozzle array including a plurality of nozzles aligned in the sub-scanning direction and a first downstream side nozzle array located on a downstream side of the first upstream side nozzle array in the sub-scanning direction and including a plurality of nozzles aligned in the sub-scanning direction; and the second ink head includes a second upstream side nozzle array including a plurality of nozzles aligned in the sub-scanning direction and a second downstream side nozzle array located on a downstream side of the second upstream side nozzle array in the sub-scanning direction and including a plurality of nozzles aligned in the sub-scanning direction;

the controller causes the nozzles in the first upstream side nozzle array to eject the color ink onto the recording medium;

the controller controls the transporter so that the recording medium with the color ink ejected thereon is transported toward the downstream side in the sub-scanning direction;

the controller causes the nozzles in the second downstream side nozzle array to eject the white ink onto the color ink on the recording medium;

the controller controls a dot size after curing of the color ink ejected onto the recording medium to be a predetermined first dot size; and the controller controls a dot size after curing of the white ink ejected onto the color ink to be a second dot size that is larger than the first dot size.

2. An inkjet printer comprising:

a first ink head that ejects a color ink on a recording medium;

a second ink head that ejects a white ink on the color ink;

a transporter that transports the recording medium from an upstream side to a downstream side in a sub-scanning direction;

a carriage that moves the first ink head and the second ink head in a main scanning direction that is perpendicular or substantially perpendicular to the sub-scanning direction;

a light emitter that emits light to cure the color ink ejected onto the recording medium and the white ink ejected onto the color ink; and a controller that controls the first ink head, the second ink head, the transporter, the carriage and the light emitter to cause the light emitter to emit light to the color ink after waiting a first time period from when the color ink has been ejected onto the recording medium and to cause the light emitter to emit light to the white ink after waiting a second time period from when the white ink has been ejected onto the color ink; wherein the first time period is less than the second time period; and a dot size of the white ink is larger than a dot size of the color ink.

3. An inkjet printer comprising:

a first ink head that ejects a color ink on a recording medium;

a second ink head that ejects a white ink on the color ink;

a transporter that transports the recording medium from an upstream side to a downstream side in a sub-scanning direction;

a carriage that moves the first ink head and the second ink head in a main scanning direction that is perpendicular or substantially perpendicular to the sub-scanning direction;

a light emitter that emits light to cure the color ink ejected onto the recording medium and the white ink ejected onto the color ink; and a controller that controls the first ink head, the second ink head, the transporter, the carriage and the light emitter to cause the light emitter to emit light to the color ink after waiting a first time period from when the color ink has been ejected onto the recording medium and to cause the light emitter to emit light to the white ink after waiting a second time period from when the white ink has been ejected onto the color ink; wherein the first time period is less than the second time period; and the color ink and the white ink are ejected onto a side of the recording medium that is opposite to a viewer side of the recording medium from which a viewer views the recording medium.

4. A method of performing inkjet printing comprising:

ejecting a color ink on a recording medium;

ejecting a white ink on the color ink; and emitting light to cure the color ink ejected onto the recording medium and the white ink ejected onto the color ink; wherein the emitting light includes emitting light to the color ink after waiting a first time period from when the color ink has been ejected onto the recording medium and emitting light to the white ink after waiting a second time period from when the white ink has been ejected onto the color ink;

the first time period is less than the second time period; and the emitting light is performed by a single light emitter.

5. The method according to claim 4, wherein the emitting the color ink and the emitting the white ink are performed such that a dot size of the white ink is larger than a dot size of the color ink.

6. The method according to claim 4, wherein the ejecting the white ink includes ejecting the white ink onto both the color ink and the recording medium.

7. The method according to claim 4, wherein the ejecting the white ink includes ejecting the white ink such that the white ink completely covers the color ink and directly contacts a portion of the recording medium.

8. The method according to claim 4, wherein the ejecting the color ink and the ejecting the white ink are performed such that the color ink and the white ink are ejected onto a side of the recording medium that is opposite to a viewer side of the recording medium from which a viewer views the recording medium.

9. A method of performing inkjet printing comprising:

ejecting a color ink on a recording medium;

ejecting a white ink on the color ink; and emitting light to cure the color ink ejected onto the recording medium and the white ink ejected onto the color ink; wherein the emitting light includes emitting light to the color ink after waiting a first time period from when the color ink has been ejected onto the recording medium and emitting light to the white ink after waiting a second time period from when the white ink has been ejected onto the color ink;

the first time period is less than the second time period;

the ejecting the color ink and the ejecting the white ink are performed by a first ink head and a second ink head, respectively, and the first ink head and the second ink head are aligned in a main scanning direction;

the first ink head includes a first upstream side nozzle array including a plurality of nozzles aligned in a sub-scanning direction and a first downstream side nozzle array located on a downstream side of the first upstream side nozzle array in the sub-scanning direction and including a plurality of nozzles aligned in the sub-scanning direction;

the second ink head includes a second upstream side nozzle array including a plurality of nozzles aligned in the sub-scanning direction and a second downstream side nozzle array located on a downstream side of the second upstream side nozzle array in the sub-scanning direction and including a plurality of nozzles aligned in the sub-scanning direction; and the method further includes:

causing the nozzles in the first upstream side nozzle array to eject the color ink onto the recording medium;

controlling a transporter so that the recording medium with the color ink ejected thereon is transported toward the downstream side in the sub-scanning direction;

causing the nozzles in the second downstream side nozzle array to eject the white ink onto the color ink on the recording medium;

controlling a dot size after curing of the color ink ejected onto the recording medium to be a predetermined first dot size; and controlling a dot size after curing of the white ink ejected onto the color ink to be a second dot size that is larger than the first dot size.

* * * * *